United States Patent [19]

Ulmer et al.

[11] Patent Number: 4,643,116

[45] Date of Patent: Feb. 17, 1987

[54] SELF-ADJUSTING PRESSER FOOT FOR SEWING MACHINES

[75] Inventors: Christian Ulmer, Steckborn, Switzerland; Georg Tröndle, Constance, Fed. Rep. of Germany

[73] Assignee: Fritz Gegauf AG. Bernina-Nähmaschinenfabrik, Steckborn, Switzerland

[21] Appl. No.: 769,862

[22] Filed: Aug. 27, 1985

[30] Foreign Application Priority Data

Sep. 19, 1984 [CH] Switzerland ..... 04486/84

[51] Int. Cl.[4] ..... D05B 29/00

[52] U.S. Cl. ..... 112/240; 403/90; 403/122; 403/375

[58] Field of Search ..... 403/375, 380, 335, 338, 403/122, 90; 112/240, 322, 235

[56] References Cited

U.S. PATENT DOCUMENTS

| | | | |
|---|---|---|---|
| 747,163 | 12/1903 | Gneist | 112/240 |
| 1,625,616 | 4/1927 | Long | 112/240 |
| 1,639,441 | 8/1927 | Spahr | 403/90 X |
| 1,779,057 | 10/1930 | Tolmach | 403/90 X |
| 1,930,628 | 10/1933 | Smallbone | 112/240 |
| 2,949,085 | 8/1960 | Schenkengel | 112/235 |
| 3,304,896 | 2/1967 | Laidig . | |
| 3,375,044 | 3/1968 | Peterson | 403/90 X |
| 3,604,044 | 9/1971 | Johnson | 403/90 X |
| 4,066,369 | 1/1978 | Furtah | 403/122 X |
| 4,214,540 | 7/1980 | Cook | 112/235 |
| 4,526,119 | 7/1985 | von Hagen | 112/322 |

FOREIGN PATENT DOCUMENTS

| | | |
|---|---|---|
| 50-77037 | 7/1975 | Japan . |
| 369009 | 6/1963 | Switzerland . |

*Primary Examiner*—Werner H. Schroeder
*Assistant Examiner*—Andrew M. Falik
*Attorney, Agent, or Firm*—Peter K. Kontler

[57] ABSTRACT

A sewing machine presser foot with a shank and a sole plate wherein the shank carries at its lower end a spherical portion extending into a complementary socket of the sole plate so that the latter is free to swivel about several intersecting axes which pass through the center of the spherical portion. A U-shaped spring couples the sole plate to the shank and limits the extent of movability of the sole plate with reference to the shank, either alone or by cooperating with two transversely extending stubs which are provided on the shank at the opposite sides of the spherical portion and extend, with freedom of vertical movement, into slots which are machined into two lateral walls of the sole plate.

19 Claims, 6 Drawing Figures

SELF-ADJUSTING PRESSER FOOT FOR SEWING MACHINES

BACKGROUND OF THE INVENTION

The present invention relates to sewing machines in general, and more particularly to improvements in presser feet for use in sewing machines. Still more particularly, the invention relates to improvements in self-adjusting presser feet, namely to presser feet wherein the sole plate is movable with reference to the shank.

The purpose of the presser foot is to urge the material being sewn toward the feed dog. The shank of the presser foot is secured to the presser bar of the sewing machine and its lower end portion carries the sole plate. As a rule, the sole plate is pivotable with reference to the shank about an axis which extends at right angles to the direction of advancement of the work when the sewing machine is in use. It is also known to provide the presser foot with a readily detachable sole plate so that the latter can be replaced with a differently configurated sole plate, e.g., for the sewing of zippers, buttons, buttonholes and others. The purpose of a movably mounted sole plate is to enable it to ride over transverse stitches and/or to permit workpiece portions of different thicknesses to advance toward, above and beyond the feed dog. If the sole plate is mounted for pivotal movement about a single axis, such axis is preferably horizontal and extends at right angles to the direction of advancement of the work.

Swiss Pat. No. 369,009 discloses a presser foot wherein the sole plate is free to perform limited movements with reference to the shank. The means for limiting such movements about a transversely extending axis includes a stud which is provided on the sole plate and extends with play into a bore of the shank. The just described presser foot is quite satisfactory when it suffices to mount the sole plate with freedom of movement about a single axis. However, it is often desirable and advantageous to enable the sole plate to perform more complex movements relative to the shank. Such movements can be performed if the sole plate is mounted in a manner as disclosed in U.S. Pat. No. 3,304,896 to Laidig. This patent teaches to mount the sole plate for pivotal movement relative to a U-shaped yoke and to mount the yoke for pivotal movement relative to the shank. The pivot axis of the sole plate extends at right angles to the direction of movement of the work and at right angles to the pivot axis of the yoke. Both pivot axes are horizontal and they do not intersect each other. A drawback of the proposal of Laidig is that the patented presser foot comprises a large number of rather complex parts which contributes to the initial cost as well as to the cost of assembling the parts of the presser foot and of mounting the assembled parts on the presser bar. Furthermore, the yoke is likely to jam in response to transfer of forces from the shank to the sole plate so that it cannot turn relative to the shank. Moreover, the pivot axis of the yoke is located at a level well above the pivot axis of the sole plate so that the sole plate is free to perform pronounced lateral movements in response to pivoting of the yoke with reference to the shank. Still further, the means for limiting the extent of pivotal movement of the yoke relative to the shank and the means for limiting the extent of pivotal movement of the sole plate relative to the yoke each comprise a substantial number of parts which must be machined with a high degree of precision and are likely to fail in response to contamination when the sewing machine is in use. This applies especially for the means which limits the extent of movability of the yoke relative to the shank and comprises a tilt stop rivet whose head is adjacent to the front side of the central panel of the yoke and whose shank extends with some play through a first hole in such central panel and without play into a second hole which is provided in the lower portion of the shank.

OBJECTS AND SUMMARY OF THE INVENTION

An object of the invention is to provide a novel and improved self-adjusting presser foot wherein the sole plate is mounted on the shank in a novel and improved way.

Another object of the invention is to provide a presser foot wherein the sole plate and the shank can move relative to each other in any one of a practically infinite number of different directions.

A further object of the invention is to provide a novel and improved shank and a novel and improved sole plate for use in the above outlined presser foot.

An additional object of the invention is to provide a sewing machine which embodies the above outlined presser foot.

Still another object of the invention is to provide novel and improved means for separably coupling the sole plate and the shank of a presser foot to each other.

A further object of the invention is to provide a novel and improved joint for use in the above outlined presser foot.

An additional object of the invention is to provide novel and improved means for limiting the extent of movability of the sole plate relative to the shank of a presser foot.

A further object of the invention is to provide a novel and improved quick-release coupling between the sole plate and the shank of a presser foot.

Another object of the invention is to provide a presser foot whose sole plate can perform any desired number of different movements relative to the shank so that the sole plate can readily ride over more or less pronounced protuberances at the upper side of the work and that the sole plate does not transmit to the work any forces which would interfere with advancement of the work in a selected direction.

A further object of the invention is to provide a novel and improved method of movably mounting the sole plate on the shank of a presser foot for use in sewing machines.

The invention is embodied in a presser foot for use in sewing machines which comprises a first component including or constituting a shank and connectable to the presser bar of the sewing machine, a second component which includes or constitutes a sole plate, and a ball and socket joint which articulately connects the first and second components to each other. The joint comprises a substantially spherical (e.g., hemispherical) portion on one of the components and a complementary socket which is provided on the other component and receives the spherical portion. The socket can be bounded by a substantially hemispherical surface and can be provided in the sole plate.

The presser foot can further comprise a pair of stubs which are disposed at the opposite sides of the spherical portion and whose common axis extends through the geometric center of the spherical portion. The stubs can be provided on the lower end portion of the shank and the sole plate is then provided with a pair of recesses, one for each of the two stubs. Such recesses can constitute substantially vertically extending slots which are machined into or are otherwise formed in two lateral walls of the sole plate and whose upper ends are open to allow for insertion of withdrawal of the respective stubs. The common axis of the stubs extends transversely of the direction of movement of the work when the sewing machine embodying the improved presser foot is in use. The sole plate is movable relative to the shank to at least one position in which the stubs are located above the deepmost portions of the respective recesses; the sole plate is then horizontal or at least substantially horizontal.

The ball and socket joint imparts to the sole plate freedom of swiveling movement with reference to the shank about a plurality of intersecting axes (the point of intersection is the geometric center of the spherical portion of the joint). The stubs and the surfaces bounding the recesses for the stubs constitute a means for limiting the extent of swiveling movement of the sole plate relative to the shank about an axis which is at least substantially normal to the common axis of the stubs and extends in the direction of movement of the material which is being sewn when the presser foot is in use.

The presser foot further comprises means for preferably releasably coupling the two components to each other. Such coupling means can comprise a substantially U-shaped spring whose web is secured to one of the two components and whose legs are disposed at the opposite sides of the shank. The web can be secured to the sole plate behind the shank. In accordance with a presently preferred embodiment of the invention, the first component has two grooves, one for each of the two legs and each receiving the respective leg with limited freedom of movement so that the legs and the surfaces bounding the grooves determine the extent of movability of the two components relative to each other about the common axis of the stubs. The width of the grooves can increase in the longitudinal direction of the respective legs and in the direction of movement of the work. The legs can overlie the open upper ends of the aforementioned recesses so that they prevent accidental withdrawal of stubs from their recesses. The free end portion of each of the legs can constitute an upwardly sloping ramp which is remote from the web of the U-shaped spring. The stubs are removable from the respective recesses upon flexing of the legs in directions upwardly and away from the respective lateral walls of the sole plate, and the stubs are reinsertable into their recesses by placing them between the upwardly sloping end portions of the corresponding legs and the adjacent lateral walls and by thereupon moving the stubs toward the respective recesses with attendant deformation of the legs. The spring can serve to bias the spherical portion of the joint into the socket.

The novel features which are considered as characteristic of the invention are set forth in particular in the appended claims. The improved presser foot itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
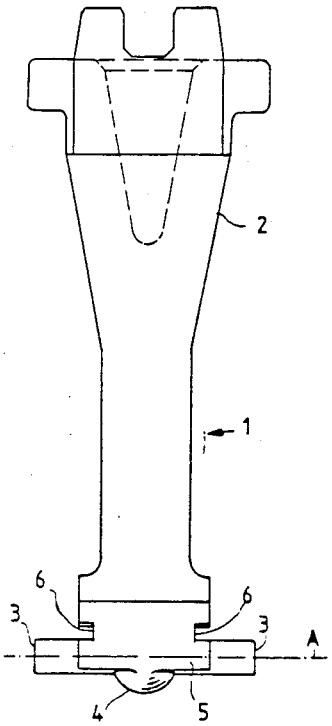
FIG. 1 is a front elevational view of the shank of a presser foot which embodies the invention.
Figure 2:
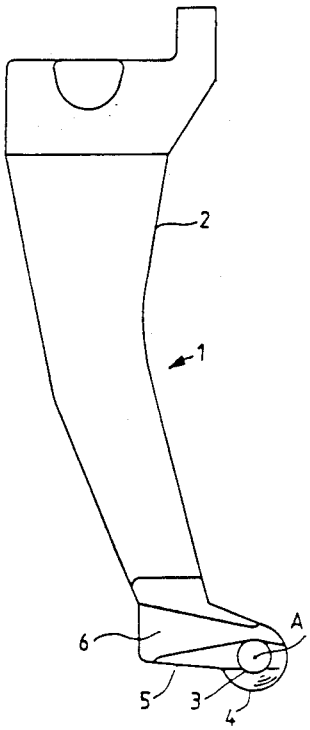
FIG. 2 is a side elevational view of the shank.

FIGS. 1 to 5 show a presser foot which comprises a first component 1 constituting an elongated shank whose upper end portion 2 is configurated in such a way that it is separably connectable to the presser bar (not specifically shown) of a sewing machine and whose lower end portion 5 is movably connected with a sole plate 7. The lower end portion 5 of the shank 1 is formed with two coaxial transversely extending stubs 3 at the opposite sides of a substantially spherical (shown as hemispherical) portion 4 which is receivable in a complementary socket 14 provided in the upper side of the central portion 8 of the sole plate 7. The common axis of the stubs 3 is shown at A; such axis extends at right angles to the direction of movement of the work when the presser foot embodying the structure of FIGS. 1 to 5 is in use in a sewing machine. The geometric center of the spherical portion 4 of the lower end portion 5 of the shank 1 is located on the axis A. The lateral surfaces of the lower end portion 5 of the shank 1 are formed with elongated substantially V-shaped grooves 6 whose width increases in the direction of advancement of work in the sewing machine and whose right-hand end portions (as viewed in FIG. 2) are located above the respective stubs 3. The width of the grooves 6 increases in a direction from the axis A toward the heel of the lower end portion 5. The shank 1 can be made of a metallic or synthetic plastic material, e.g., in an extruding or stamping machine.

The central portion 8 the sole plate 7 is substantially flat and has a forwardly and upwardly sloping bifurcated end portion 9. The underside of the central portion 8 is in contact with the work when the presser foot is in use and such central portion is integral with two lateral walls 10 which are adjacent to the respective grooves 6 when the sole plate 7 is assembled with the lower end portion 5 of the shank 1. The bifurcated end portion 9 facilites the introduction of the leading edge of a piece of work into the space between the underside of the central portion 8 and the feed dog, not shown. The prongs of the end portion 9 are denoted by the character 19.

The upper sides of the lateral walls 10 of the sole plate 7 are formed with recesses 11 in the form of elongated slots whose bottom portions are adjacent to the upper side of the central portion 8 and whose upper ends are open to allow for insertion of the respective stubs 3. Each of the recesses 11 is bounded by a surface 12 which includes two substantially parallel portions extending downwardly from the upper side of the respective lateral wall 10 and close to the level of the upper side of the central portion 8. The bottom portions of the recesses or slots 11 are bounded by substantially semicylindrical portions 13 of the respective surfaces 12.

Figure 3:
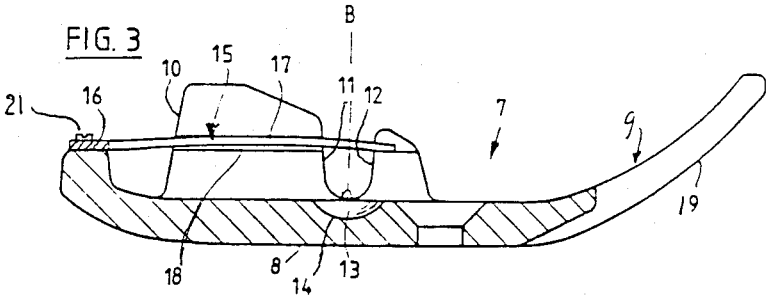
FIG. 3 is a central longitudinal vertical sectional view of the sole plate and of the U-shaped spring.
Figure 4:
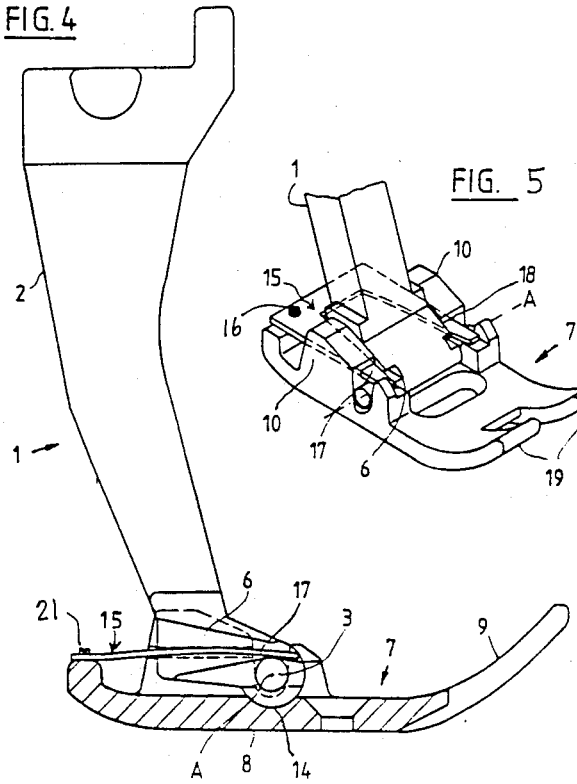
FIG. 4 is a side elevational view of the presser foot which includes the shank of FIGS. 1–2 and the sole plate of FIG. 3, the sole plate being shown in a sectional view corresponding to that of FIG. 3.
Figure 5:
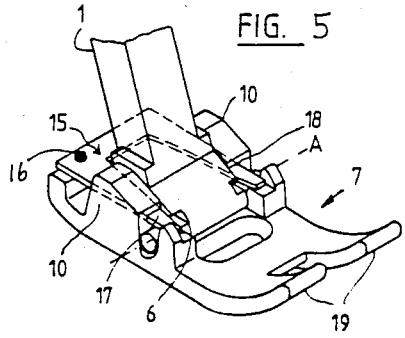
FIG. 5 is a fragmentary perspective view of the structure which is shown in the lower part of FIG. 4.

The geometric center of the socket 14 in the upper side of the central portion 8 is located in a vertical plane B which halves each of the slots 11 (see particularly FIG. 3).

The means for coupling the components 1 and 7 of the presser foot to each other comprises a U-shaped spring 15 whose web 16 is separably affixed to the left-hand end portion of the sole plate 7, as viewed in FIG. 3, by one or more screws 21 or other suitable fasteners and whose legs 17 are elongated and extend into the respective grooves 6 of the lower end portion 5 of the shank 1. Each of the legs 17 further extends into an elongated narrow groove 18 in the inner side of the respective lateral wall 10. The free end portions of the legs 17 are located between the socket 14 and the front end portion 9 of the sole plate 7.

When the sole plate 7 is assembled with the lower end portion 5 of the shank 1, intermediate portions of the legs 17 of the U-shaped spring 15 overlie the open upper ends of the corresponding slots 11 and thus prevent accidental escape or withdrawal of the stubs 3 to thereby ensure that the sole plate 7 is properly coupled to the shank 1 in such a way that the spherical portion 4 extends into the socket and the sole plate can swivel about a plurality of axes which intersect each other in the geometric center of the spherical portion 4. The legs 17 of the spring 15 bias the spherical portion 4 into the socket 14. Moreover, each of the legs 17 extends into the respective V-shaped groove 6 so that they cooperate with the surfaces bounding the grooves 6 to determine the extent to which the sole plate 7 can swivel relative to the shank 1 about the common axis A of the stubs 3. The stubs 3 are spaced apart from the lowermost portions 13 of the surfaces 12 bounding the respective slots 11 when the central portion 8 of the sole plate 7 is at least substantially horizontal. These stubs and the portions 13 of the surfaces 12 in the corresponding slots 11 determine the extent to which the sole plate 7 can swivel relative to the shank 1 about an axis which is normal to the axis A and extends in the direction of advancement of work relative to the sole plate. The convex surface of the spherical portion 4 cooperates with the complementary concave surface in the socket 14 under the action of the spring 15 to ensure that the sole plate 7 cannot wobble with reference to the shank 1, i.e., the sole plate can swivel about several axes but each of these axes extends through the geometric center of the spherical portion 4. The transmission of forces from the shank 1 to the pressure plate 7 or vice versa takes place by way of the spherical portion 4.

Figure 6:
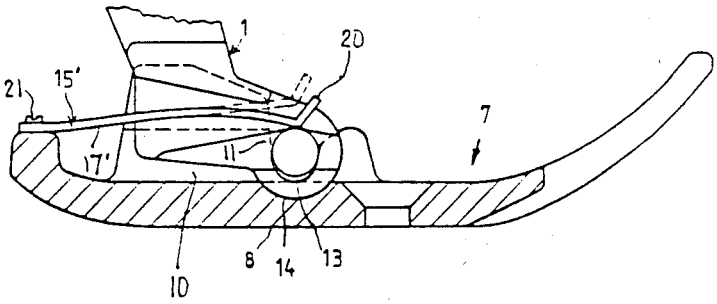
FIG. 6 is a fragmentary partly side elevational and partly central longitudinal vertical sectional view of a second presser foot with a modified spring and a readily detachable sole plate.

FIG. 6 shows a portion of a modified presser foot wherein the free end portions 20 of the legs 17' of a somewhat modified U-shaped spring 15' are bent upwardly and away from the upper sides of the respective lateral walls 10. The upwardly bent free end portions 20 enable the user of the sewing machine to rapidly attach to the shank 1 any one of a number of different sole plates 7 by the simple expedient of inserting the stubs 3 between the respective free end portions 20 and the upper sides of the corresponding lateral walls 10 and by advancing the stubs 3 to the left, as viewed in FIG. 6, until they enter the corresponding slots 11. In order to withdraw the stubs 3 from the corresponding slots 11, the user of the sewing machine urges the stubs upwardly so as to deform the respective legs 17' (note the broken-line positions of such legs in FIG. 6) until the legs 17' and the respective lateral walls 10 allow for extraction of the stubs and for movement of the extracted stubs toward and below the respective end portions 20. In all other respects, the presser foot which embodies the structure of FIG. 6 can be identical with or analogous to the presser foot of FIGS. 1 to 5.

An important advantage of the improved presser foot is that the sole plate 7 can swivel with reference to the shank 1 irrespective of the magnitude of forces which are being transmitted via spherical portion 4 and that the sole plate cannot cause unpredictable lateral movements of the work. Moreover, the presser foot is inexpensive because it comprises a small number of relatively simple parts which can be mass-produced in available machines. The stubs 3 render it possible to accurately control the extent of movability of the sole plate 7 relative to the shank 1 about the axis A as well as about an axis which is normal to the axis A and extends in the longitudinal direction of the central portion 8. The extent of pivotability of the sole plate 7 can be determined by the simple expedient of adequately selecting the depth of the slots 11. The depth of the slots 11 can vary from sole plate to sole plate so that each of a small or large number of different sole plates can be tilted to a different extent.

The structure which is shown in FIG. 6 exhibits the advantage that the sole plate 7 can be attached to or detached from the shank 1 without any tools. The sole plate 7 of the presser foot which is shown in FIGS. 1–5 can be separated from the shank 1 by the simple expedient of removing the fasteners 21 which are used to secure the web 16 of the spring 15 to the respective end portion of the sole plate.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A sewing machine presser foot comprising a first component constituting a shank and arranged to be connected to the presser bar of a sewing machine; a second component constituting a sole plate; and a ball and socket joint articulately connecting said components to each other so that the sole plate can change its position relative to said shank while the presser bar is in actual use in the sewing machine, said joint comprising a substantially spherical portion on one of said components and a complementary socket provided for said spherical portion on the other of said components, said second component having freedom of movement with reference to said first component about a plurality of axes which intersect each other and are defined by said joint.

2. The presser foot of claim 1, wherein said socket is provided in said second component.

3. The presser foot of claim 1, further comprising means for releasably coupling said components to each other.

4. The presser foot of claim 3, wherein said coupling means comprises a substantially U-shaped spring having a web secured to one of said components and two legs disposed at the opposite sides of said first component.

5. The presser foot of claim 4, wherein said web is secured to said second component.

6. The presser foot of claim 1, wherein said other component has a substantially hemispherical surface bounding said socket.

7. The presser foot of claim 1 further comprising means for limiting the extent of movability of said second component about at least one of said axes.

8. The presser foot of claim 1, further comprising means for biasing said spherical portion into said socket.

9. A sewing machine presser foot comprising a first component constituting a shank and arranged to be connected to the presser bar of sewing machine; a second component constituting a sole plate; a ball and socket joint articulately connecting said components to each other and comprising a substantially spherical portion on one of said components and a complementary socket provided for the spherical portion on the other of said components, said spherical portion having a geometric center; and a pair of stubs disposed at the opposite sides of said spherical portion and having a common axis which extends through said geometric center, said stubs being provided on one of said components and the other of said components having a pair of recesses, one for each of said stubs.

10. The presser foot of claim 9, wherein said stubs are provided on said first component and said recesses are slots having open upper ends.

11. The presser foot of claim 9, wherein said second component has two lateral walls flanking said joint and said recesses are provided in said lateral walls.

12. The presser foot of claim 11, wherein said recesses have bottom portions and said second component is movable relative to said first component to at least one position in which said stubs are located above the bottom portions of the respective recesses.

13. The presser foot of claim 12, wherein said second component is at least substantially horizontal in said one position thereof.

14. The presser foot of claim 9, wherein second component has freedom of swiveling movement with reference to said first component about a plurality of intersecting axes which are defined by said joint, said stubs and the surfaces bounding said recesses constituting a means for limiting the extent of swiveling movement of said second component about an axis which is at least substantially normal to said common axis and extends in the direction of movement of the material being sewn when the presser foot is in use.

15. A sewing machine presser foot comprising a first component constituting a shank and arranged to be connected to the presser bar of a sewing machine; a second component constituting a sole plate; a ball and socket joint articulately connecting said components to each other and comprising a substantially spherical portion on one of said components and a complementary socket provided for the spherical portion on the other of said components; and means for releasably coupling said components to each other, comprising a substantially U-shaped spring having a web secured to said second component and two legs disposed at the opposite sides of said first component, said first component having grooves, one for each of said legs and each receiving the respective leg with limited freedom of movement so that said legs and the surfaces bounding said grooves determine the extent of movability of said components relative to each other about a common axis.

16. The presser foot of claim 15, wherein said legs are elongated and the width of said grooves varies as considered in the longitudinal direction of the respective legs.

17. A sewing machine presser foot comprising a first component constituting a shank and arranged to be connected to the presser bar of a sewing machine; a second component constituting a sole plate; a ball and socket joint articulately connecting said components to each other and comprising a substantially spherical portion on one of said components and a complementary socket provided for the spherical portion on the other of said components; and means for releasably coupling said components to each other, comprising a substantially U-shaped spring having a web secured to said second component and two legs disposed at the opposite sides of said first component, said first component including two transversely extending stubs and said second component having two lateral walls flanking said joint and provided with recesses for said stubs, said recesses having open tops and each of said legs overlying the open top of a different one of said recesses.

18. The presser foot of claim 17, wherein said legs have upwardly sloping free end portions which are remote from said web.

19. The presser foot of claim 18, wherein said stubs are removable from the respective recesses upon flexing of said legs away from the respective lateral walls, said stubs being reinsertable into the corresponding recesses by placing them between the end portions of the respective legs and the adjacent lateral walls and by thereupon moving the stubs toward the respective recesses with attendant deformation of said legs.

* * * * *